US006216601B1

(12) United States Patent
Zacharias

(10) Patent No.: US 6,216,601 B1
(45) Date of Patent: Apr. 17, 2001

(54) APPARATUS FOR LIMITING A TRAVEL PATH OF A RUNNING GEAR, IN PARTICULAR OF A HOIST

(75) Inventor: Karl Zacharias, Schwerte (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/300,031

(22) Filed: Apr. 27, 1999

(30) Foreign Application Priority Data

May 8, 1998 (DE) ..... 198 22 109

(51) Int. Cl.[7] ..... B61K 5/04

(52) U.S. Cl. ..... 104/249; 104/250; 104/251; 104/254; 104/258; 104/147; 212/329

(58) Field of Search ..... 104/249, 250, 104/251, 254, 258, 147; 212/329

(56) References Cited

U.S. PATENT DOCUMENTS

| | | | | |
|---|---|---|---|---|
| 1,074,407 | * | 9/1913 | Braden | 104/258 |
| 2,037,589 | * | 4/1936 | Pilkington | 104/258 |
| 2,053,179 | * | 9/1936 | Brown | 104/258 |
| 2,359,106 | * | 9/1944 | Hayes | 104/258 |
| 2,789,517 | * | 4/1957 | Hayes | 104/258 |

FOREIGN PATENT DOCUMENTS

| | | | | |
|---|---|---|---|---|
| 476654 | * | 9/1951 | (CA) | 104/258 |
| OS 23 19 185 | | 10/1974 | (DE) . | |
| 2319185 | * | 10/1974 | (DE) | B66C/7/16 |
| 30 46 882 C2 | | 7/1982 | (DE) . | |
| 3223705A1 | * | 12/1983 | (DE) | B61K/7/16 |
| 3046882C2 | * | 6/1994 | (DE) | B66C/7/16 |
| 3223705 | * | 12/1983 | (GB) | 104/249 |

* cited by examiner

*Primary Examiner*—S. Joseph Morano
*Assistant Examiner*—Frantz F. Jules
(74) *Attorney, Agent, or Firm*—Henry M. Feiereisen

(57) ABSTRACT

Apparatus for limiting a travel path of running gears, in particular hoists, traveling along a running rail of a type having at least one flange and a web, includes a pair of side elements which are securable to opposite sides of the flange and provided with at least one buffer, and a clamping unit in the form of a tie element, for bracing the side elements together and pressing the side elements against the sides of the flange. In order to permit the travel path limitation apparatus to be useable above as well as below the running rail, the side elements have a first pair of aligned through-holes and a second pair of aligned second throughholes oriented parallel to the first pair of throughholes, whereby the tie element extends through the first pair of throughholes of the side elements in a first attachment position of the side elements and extends through the second pair of through-holes of the side elements in a second attachment position in which the side elements are rotated in a vertical direction by 180°. The side elements are urged against one of the flange surfaces by tensioning members which bear upon the flange, whereby support members, positioned in the side elements, support the tensioning member.

17 Claims, 5 Drawing Sheets

APPARATUS FOR LIMITING A TRAVEL PATH OF A RUNNING GEAR, IN PARTICULAR OF A HOIST

CROSS-REFERENCES TO RELATED APPLICATIONS

This application claims the priority of German Patent Application, Ser. No. 198 22 109.6, filed May 8, 1998, the subject matter of which is incorporated herein by reference.

BACKGROUND OF THE INVENTION

The present invention relates to an apparatus for limiting a travel path of a running gear moving along a running rail of a type having at least one flange and a web.

German patent specification DE-OS 23 19 185 describes a travel path limitation apparatus of a type including two claw-like side elements which are formed with buffers and secured against opposite sides of the flange. A clamping unit in the form of a tie element braces the side elements together and presses the side elements, when being installed, against both sides of the flange. In addition, the side elements are urged by tensioning elements in the form of screws against one of the flange surfaces. When installed, the side elements have two aligned throughholes through which the tie element is guided. This conventional travel path limitation apparatus suffers the shortcomings that the buffers are always positioned on the inside of the flange. Thus, the use of this travel path limitation apparatus is not suitable for running gears in which guide wheels are disposed, when viewed in travel direction, in front of and behind the running wheels.

German Pat. No. DE 30 46 882 C2 describes a travel path limitation apparatus with claw-like side elements which can be affixed to the flange in two attachment positions through vertical rotation of the side elements about 180°. For this purpose, the side elements have a first pair of aligned throughholes and a second pair of aligned throughholes in parallel disposition to the first pair of throughholes for selective disposition of the tie element. The securement of the side elements is realized in both attachment positions by two identical clamp pieces which have a triangular configuration in lateral projection. The attachment of the travel path limitation apparatus is realized by so disposing the clamp pieces on each side that their hypotenuse areas abut one another, with one of the clamping members being pressed by the tie element against the outside of the flange at exploitation of the wedging effect. The vertical positioning of the other (second) clamping member during assembly of the travel path limitation apparatus is realized by an oblong hole through which the tie element is guided. This conventional travel path limitation apparatus suffers the drawback of a relatively complex structure by means of the two clamp pieces, and thus requires a relatively complicated assembly. Moreover, this type of travel path limitation apparatus is not suitable in either one of the attachment positions for flanges with slanted inner sides.

SUMMARY OF THE INVENTION

It is thus an object of the present invention to provide an improved travel path limitation apparatus for running gears, obviating the afore-stated drawbacks.

In particular, it is an object of the present invention to provide an improved travel path limitation apparatus for running gears, in particular hoists, which is so constructed as to realize a limitation of the travel path above as well as below the running rail.

These objects, and others which will become apparent hereinafter, are attained in accordance with the present invention by providing a pair of side elements respectively secured to opposite sides of the flange and including at least one buffer, with the side elements having a first pair of aligned throughholes and a second pair of aligned throughholes oriented parallel to the first pair of throughholes, a clamping unit having a tie element for bracing the side elements to one another and pressing the side elements against the sides of the flange, with the tie element extending through the first pair of throughholes of the side elements in a first attachment position of the side elements and extending through the second pair of throughholes of the side elements in a second attachment position in which the side elements are rotated in a vertical direction by 180°, and further by providing tensioning members for urging the side elements against one of the flange surfaces, and support members positioned in the side elements for supporting the tensioning members.

In accordance with the present invention, it is now possible to so attach the travel path limitation apparatus that the buffer can be selectively disposed above or below the flange. In conjunction with running gears having guide wheels positioned in front of and behind the running wheels, as viewed in direction of movement, the buffer can be disposed underneath the flange so that the buffer action is realized during impact of the running gear upon the housing or frame of the running gear. As a consequence of being also attachable to the upper flange, the travel path limitation apparatus can be used also for running gears that move along the upper flange. Thus, the added capability to attach the side elements through turning in vertical direction results in a more universal use.

A travel path limitation apparatus of the present invention can be made of simple structure when both inside surfaces of the flange one either side of the web and the outside surface of the flange extend parallel to one another.

Advantageously, each side element has an inwardly directed U-shaped groove, with the groove respectively encompassing the sides of the flange in the first attachment position as well as in the second attachment position of the side elements when the side elements have been installed. In this manner, the travel path limitation apparatus is useable for different flange widths while still being capable to absorb great impulse forces as the same time.

Suitably, the groove of each side element has a rectangular cross section to enhance mechanical properties of the travel path limitation apparatus.

The mechanical stability can be improved by arranging the clamping unit in immediate confronting disposition to the outer flange surface, so that the travel path limitation apparatus as a whole encompasses the flange of the running rail.

According to another feature of the present invention, the tie element of the clamping unit is provided in the form of a threaded spindle having opposite ends traversing the first pair of throughholes in the one attachment position and traversing the second pair of throughholes in the other attachment position, with fasteners being provided for securing the threaded spindle on both ends to the side elements.

For reasons of stability, the threaded spindle extends parallel to the outer flange surface and transversely to the web. The required stability is ensured when the threaded spindle extends at a distance to the outer flange surface. Suitably, the tensioning members extend transversely to the threaded spindle to further enhance the mechanical stability.

In order to realize a high mechanical load-absorbing capability in both attachment positions of the side elements, the tensioning members extend vertically through one of the parallel side walls of the groove and projects across the groove. Suitably, the side walls of the groove extend parallel to the outer flange surface to realize a stable and constructively simple solution. The tensioning members may be formed as screw fasteners which are supported against the inner flange surfaces or the outer flange surface.

In a most simple manner, the side elements may be secured to the threaded spindle by means of nuts screwed to the ends of the threaded spindle.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
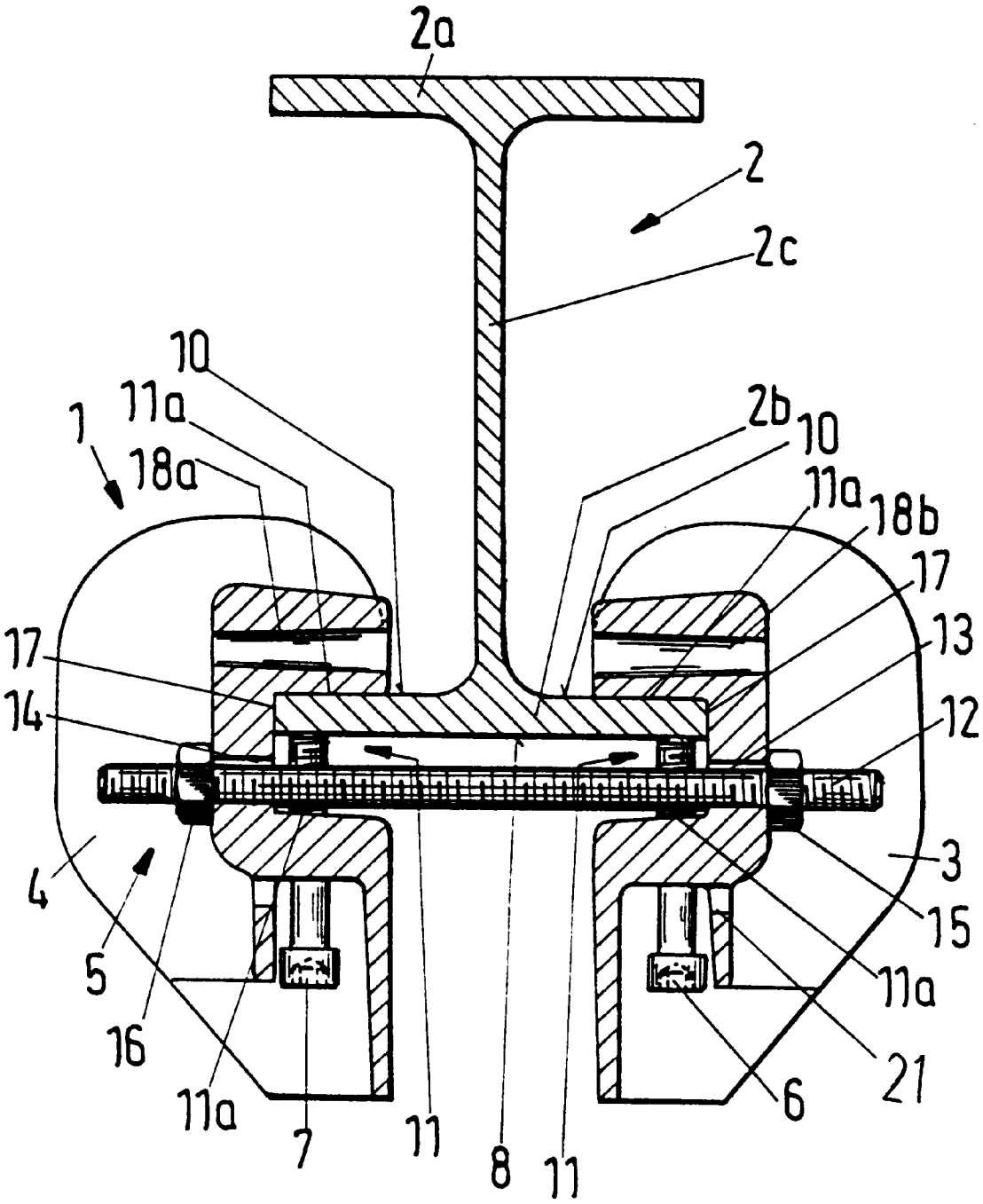
FIG. 1 is a sectional view of one embodiment of an apparatus for limiting a travel path according to the present invention, in undermounted attachment position with respect to the running rail.

Throughout all the Figures, same or corresponding elements are generally indicated by same reference numerals.

Turning now to the drawing, and in particular to FIG. 1, there is shown a sectional view of one embodiment of an apparatus for limiting a travel path according to the present invention, generally designated by reference numeral 1 in undermounted attachment position with respect to a running rail, generally designated by reference numeral 2. The running rail 2 is substantially I-shaped in cross section to thereby define an upper flange 2*a*, a lower flange 2*b* and a web 2*c* which extends between the upper and lower flanges 2*a*, 2*b*. Thus, the lower flange 2*b* defines two inner surfaces 10, separated by the web 2*c*, and an outer surface 8, with the inner surfaces 10 and the outer surface 8 extending in parallel relationship. Traveling on the running rail 2, either along the inner flange surfaces 10 or along the upper flange 2*a*, is a running gear (not shown) with its running wheels (not shown), with the travel path limitation apparatus 1 preventing the advancing running gear from moving beyond a predetermined area of the running rail 2.

The travel path limitation apparatus 1 includes two side elements 3, 4 for respective attachment to both lateral ends of the lower flange 2*b*. Persons skilled in the art will understand that the attachment of the travel path limitation apparatus 1 to the lower flange 2*b* is described by way of example only, as the apparatus 1 can certainly equally be secured to the upper flange 2*a*. The side elements 3, 4 are of claw-like configuration to encompass the lateral ends of the flange 2*b* and are firmly braced to one another by a clamping unit, generally designated by reference numeral 5. In order to maintain the side elements 3, 4 in place and to prevent a tilting of the side elements 3, 4, tensioning members in the form of screw fasteners 6, 7 are provided by which the side elements 3, 4 are pressed against the outer flange surface 8 and which transmit vertically upwardly directed forces into the running rail 2.

Figure 2:
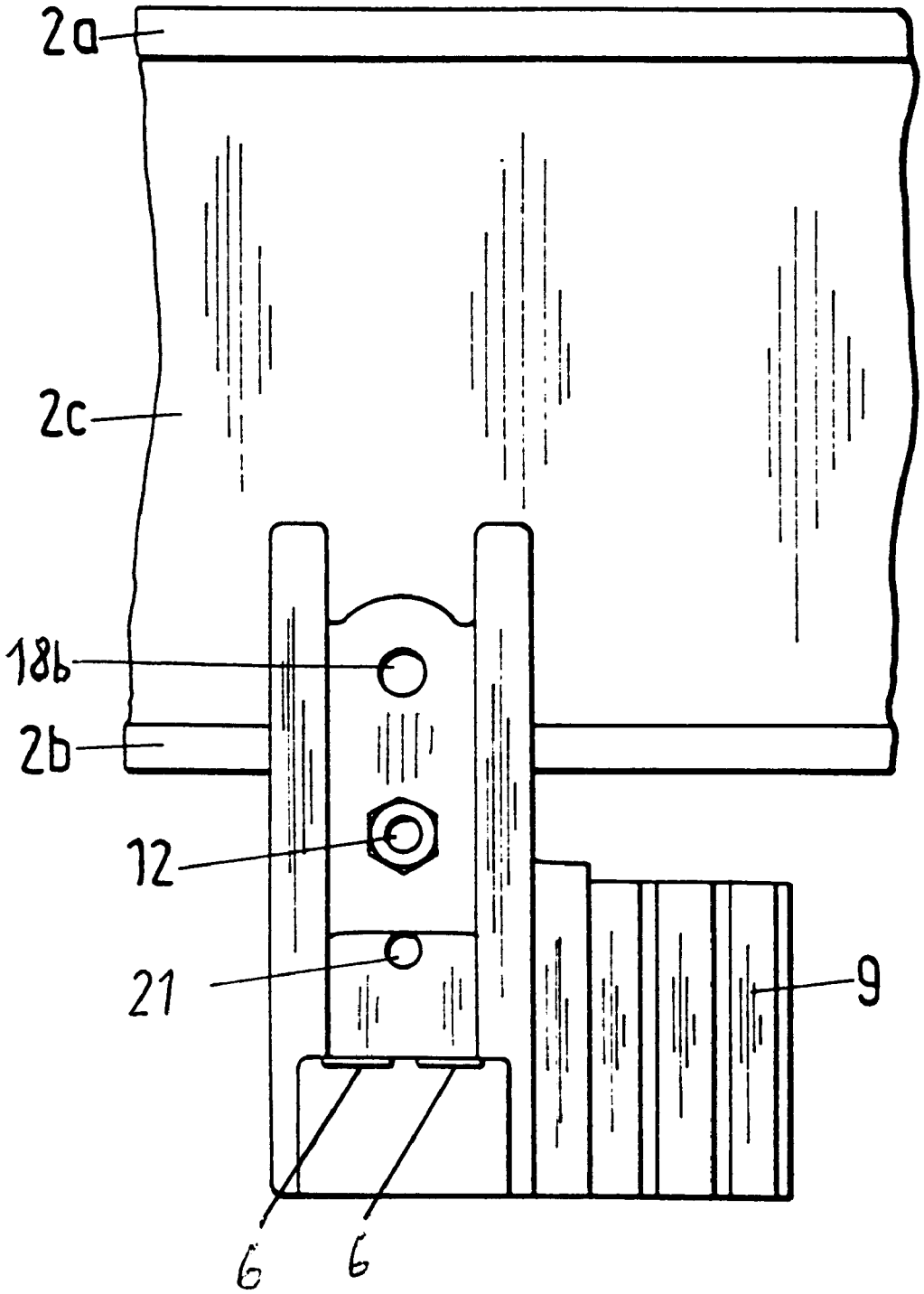
FIG. 2 is a side view of the travel path limitation apparatus of FIG. 1, showing in detail the provision of a buffer underneath the running rail.

As indicated in FIG. 2, each side element 3, 4 is provided with an anchoring groove 20 (cf. FIG. 5) for attachment of a buffer 9 which is made of rubber and positioned beneath the flange 2*b* for elastically taking the impulse forces generated during impact of the running gear. In the nonlimiting example of FIG. 1, the running wheels rollingly contact the inner surfaces 10 of the flange 2*b*, i.e. the frame or housing of the running gear impacts the buffer 9.

Each side element 3, 4 is formed with an inwardly directed U-shaped groove 11 which is substantially rectangular in cross section and is bounded by side walls 11*a*, which extend substantially parallel to one another, and a bottom 17. When the side elements 3, 4 are installed, the grooves 11 confront one another and extend in longitudinal direction of the running rail 2.

The clamping unit 5 in immediate confronting disposition to the outer flange surface 8 includes a tie element in the form of a threaded spindle 12 having opposite axial ends respectively projecting through aligned throughholes 13, 14 in the side elements 3, 4. Fasteners in the form of nuts 15, 16 firmly secure the threaded spindle 12 on both axial ends to the side elements 3, 4, thereby pressing the bottom 17 of each groove 11 against the confronting lateral ends of the flange 2*b*. As stated above, the tensioning member 6, 7 are provided to stabilize the side elements 3, 4 and extend vertically through the lower side wall 11*a* of the groove 11 to project across the groove 11 for tightening against the outer flange surface 8, whereby the lower side wall 11*a* of each groove 11 is formed with an internal thread for threaded engagement with the external thread of the tensioning members 6, 7. As both inner flange surfaces 10 and the outer flange surface 8 are in parallel relation to one another, the inner flange surfaces 10 of the lower flange 2*b* are forced in flat engagement with the upper side wall 11*a* of the groove 11 by the tensioning members 6, 7. It will be appreciated by persons skilled in the art that the use of the terms "lower" and "upper" are to be understood with respect to the illustration of FIG. 1, and may change in dependence on the desired attachment of the travel path limitation apparatus 1.

Figure 5:
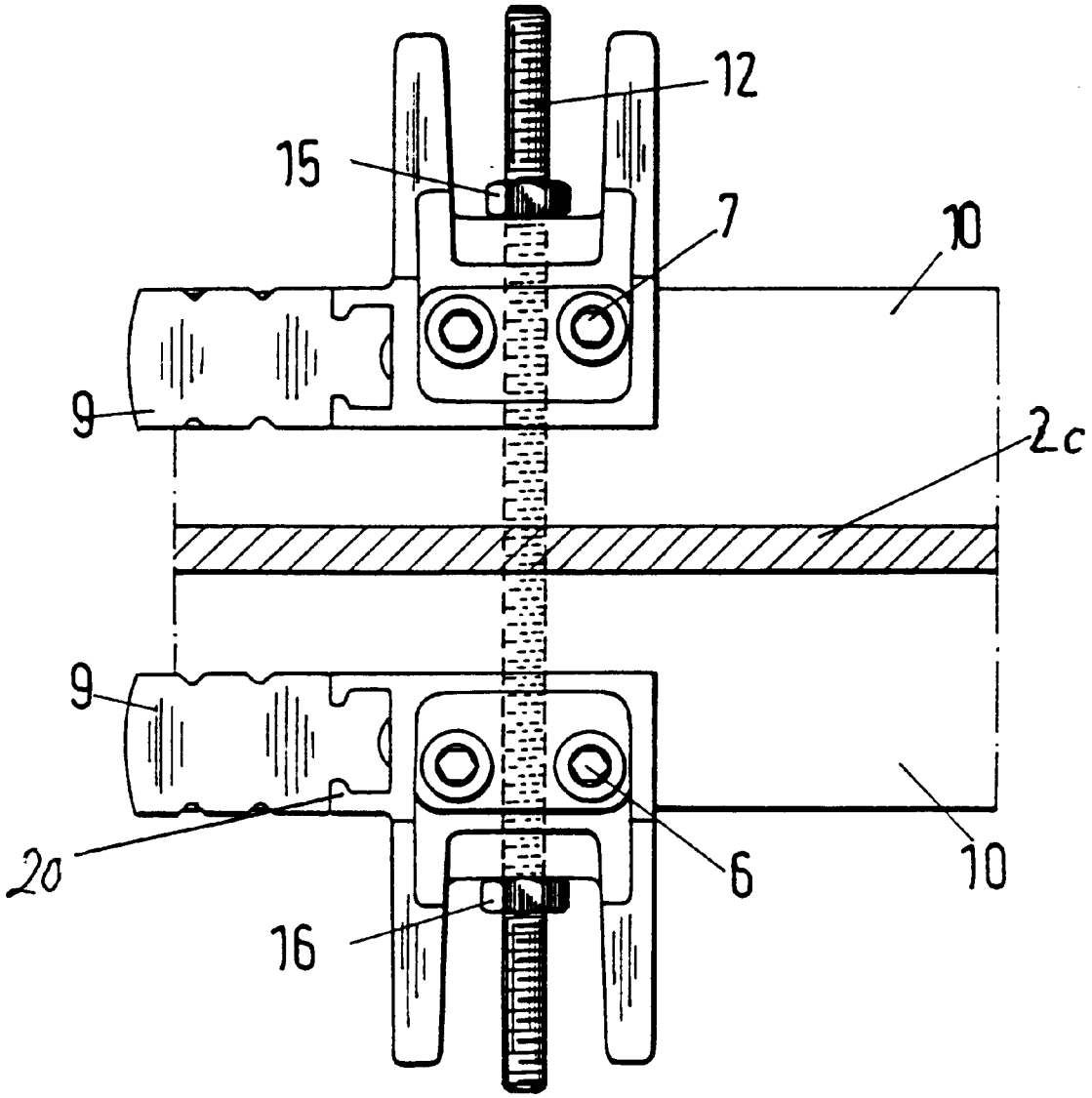
FIG. 5 is a top view of the travel path limitation apparatus of FIG. 3.

As further shown in FIG. 1, the threaded spindle 12 extends parallel at a distance to the outer flange surface 8 and transversely to the web 2*c*, whereas the tensioning members 6, 7 are oriented transversely to the threaded spindle 12. As best seen in FIG. 5, each side element 3, 4 is stabilized by two such tensioning members 6, 7 which are spaced from one another in longitudinal direction of the running rail 2. The side walls 11*a* of the groove 11 extend also parallel to the outer flange surface 8.

Figure 3:
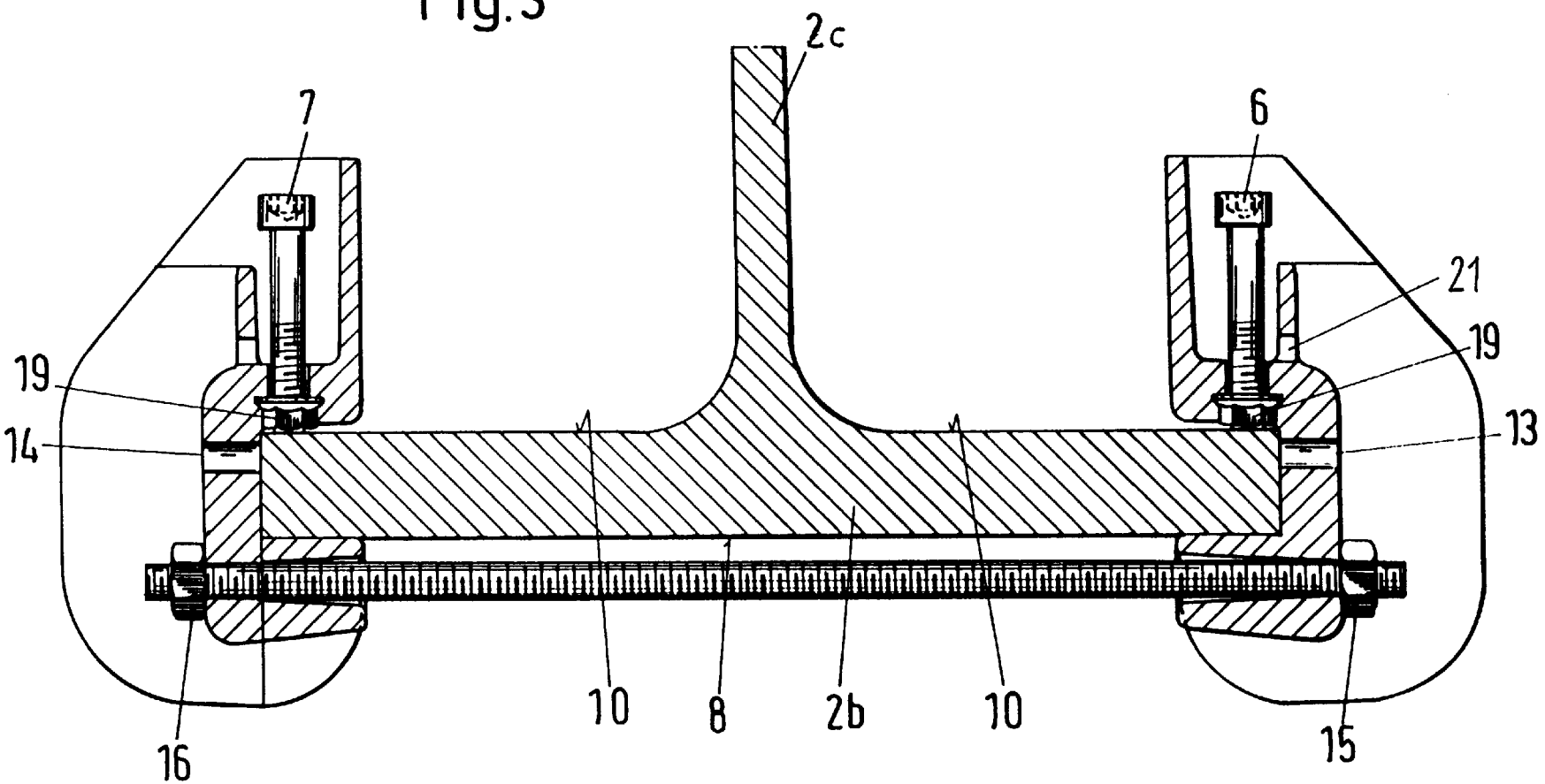
FIG. 3 is a sectional view of the travel path limitation apparatus of FIG. 1 in a 180° vertically turned attachment position.

Referring back to FIG. 1, it can be seen that the side elements 3, 4 are formed, in addition to the aligned throughholes 13, 14 which extend through the bottom 17 of the grooves 11, with a second pair of throughholes 18*a*, 18*b* in parallel relation to the throughholes 13, 14 on the side of the grooves 11 opposite to the tensioning members 6, 7. The provision of the throughholes 18*a*, 18*b* permits the attachment of the side elements 3, 4 to the flange 2*b* in a second disposition by vertically turning the side elements 3, 4 by 180°. The 180° turned disposition of the travel path limitation apparatus 1 is shown in FIG. 3 which in addition shows by way of example only a running rail with a flange 2*b* of comparably greater thickness to show the versatility of the travel path limitation apparatus of the present invention. In the disposition of FIG. 3, the side elements 3, 4 encompass with their U-shaped groove 11 the lateral flange ends, with the grooves 11 confronting one another. However, as a consequence of the 180° turned disposition of the travel path limitation apparatus 1, the tensioning members 6, 7 bear against the inner flange surfaces 10.

Figure 4:
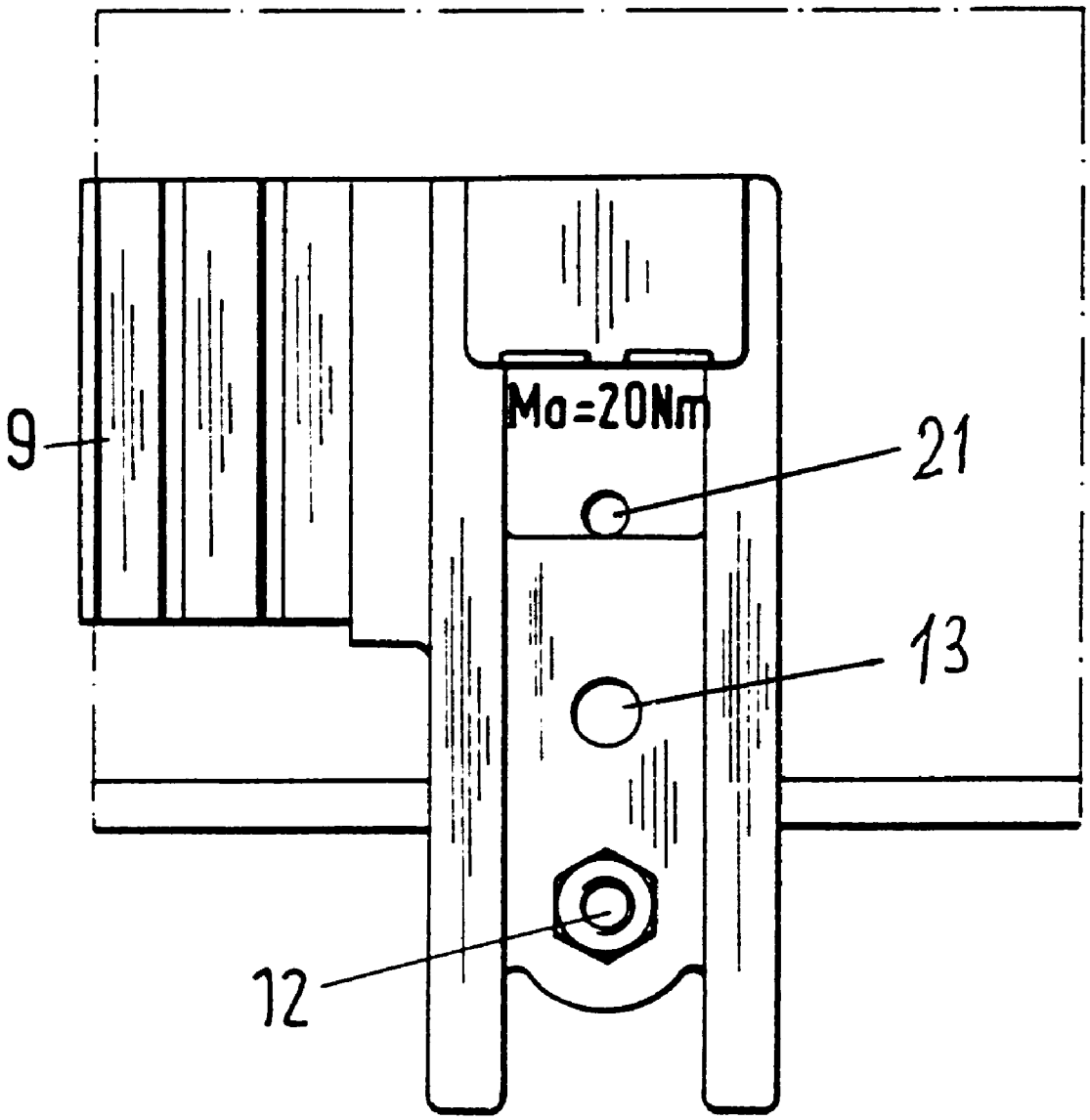
FIG. 4 is a side view of the travel path limitation apparatus of FIG. 3.

Turning now to FIGS. 4 and 5, which show side and top plan views of the travel path limitation apparatus of FIG. 3, it can be seen that the buffers 9 are now disposed inside the running rail 2 so that the running wheels of the running gear impact against the buffers 9, as indicated in FIG. 5.

Suitably, the side elements 3, 4 have provided therein support elements 19 for receiving the tensioning members 6, 7. This is especially advantageous when making the side elements of cast aluminum whereby the support elements 19 are cast in the mold with the side elements 3, 4. Examples of such support elements 19 include nuts, as shown in FIG. 3. Thus, the tensioning members 6, 7 for propping the side elements 3, 4 are supported by the flange 2*b* and the support elements 19, with the support elements 19 located in the side elements 3, 4 either on the side of the flange 2*b* distal to the tie element 12, or on the same side as the tie element 12. Although not shown in FIG. 1, persons skilled in the art will understand that such support elements 19 are also embedded in the side elements 3, 4 for support of the tensioning members 6, 7 which, in this attachment position, threadedly pass through the respective support elements.

As shown in particular in FIGS. 2 and 4, the side elements 3, 4 are each further formed with a drainage bore 21 for permitting drainage of water in the event the travel path limitation apparatus 1 is operated outdoors and thus to prevent accumulation of water in this area.

While the invention has been illustrated and described as embodied in an apparatus for limiting a travel path of a running gear, in particular a hoist, it is not intended to be limited to the details shown since various modifications and structural changes may be made without departing in any way from the spirit of the present invention.

What is claimed as new and desired to be protected by Letters Patent is set forth in the appended claims:

1. Apparatus for limiting a travel path of running gears moving along a rail of a type having at least one flange and a web, said apparatus comprising:

a pair of claw-like side elements, one side element secured to one side of the flange and provided with at least one buffer, and the other side element secured to an opposite side of the flange and provided with at least one buffer, said side elements having a first pair of aligned throughholes and a second pair of aligned second throughholes oriented parallel to the first pair of throughholes;

a clamping unit having a tie element for bracing the side elements and pressing the side elements against the sides of the flange, said tie element extending through the first pair of throughholes of the side elements in a first attachment position of the side elements and extending through the second pair of throughholes of the side elements in a second attachment position in which the side elements are rotated in a vertical direction by 180°;

tensioning means, bearing upon the flange, for urging the side elements against a flange surface; and support means, positioned in the side elements on one of a side proximal to the tie element and on a side distal to the tie element, for supporting the tensioning means.

2. The apparatus of claim 1 wherein each of the side elements has an inwardly directed U-shaped groove for encompassing the associated lateral flange end in the first and second attachment positions.

3. The apparatus of claim 2 wherein the groove of each side element has a rectangular cross section.

4. The apparatus of claim 2 wherein one of the two throughholes of each side element traverses a bottom of the groove, with the other one of the two throughholes being positioned on the tensioning means opposite side of the groove.

5. The apparatus of claim 2 wherein the groove of each side element is bounded by opposite side walls in parallel relationship, said tensioning means extending vertically through one of the side walls of the groove and projecting across the groove.

6. The apparatus of claim 5 wherein the side walls of the groove extend parallel to an outer surface of the flange.

7. The apparatus of claim 1 wherein the tie element is positioned in immediate confronting disposition to an outer surface of the flange.

8. The apparatus of claim 1 wherein the tie element is a threaded spindle having opposite ends respectively traversing the first pair of throughholes in the one attachment position and respectively traversing the second pair of throughholes in the other attachment position, and further comprising fastening means for securing the threaded spindle on both ends to the side elements.

9. The apparatus of claim 8 wherein the fastening means include nuts.

10. The apparatus of claim 1 wherein the support means are nuts cast in the side elements.

11. The apparatus of claim 1 wherein the tie element extends parallel to an outer surface of the flange and transversely to the web.

12. The apparatus of claim 11 wherein the tie element is positioned at a distance to the outer surface of the flange.

13. The apparatus of claim 1 wherein the tensioning means extend transversely to the tie element.

14. The apparatus of claim 1 wherein the tensioning means include screw fasteners.

15. In combination:

a rail having at least one flange and a web;

an apparatus for limiting a travel path of running gears moving along the rail, said apparatus comprising:

a pair of claw-like side elements, one side element secured to one side of the flange and provided with at least one buffer, and the other side element secured to an opposite side of the flange and provided with at least one buffer, said side elements having a first pair of aligned throughholes and a second pair of aligned second throughholes oriented parallel to the first pair of throughholes;

a clamping unit having a tie element for bracing the side elements and pressing the side elements against the sides of the flange, said tie element extending through the first pair of throughholes of the side elements in a first attachment position of the side elements and extending through the second pair of throughholes of the side elements in a second attachment position in which the side elements are rotated in a vertical direction by 180°;

tensioning means, bearing upon the flange, for urging the side elements against a flange surface; and support means, positioned in the side elements on one of a side proximal to the tie element and on a side distal to the tie element, for supporting the tensioning means.

16. The combination of claim 15 wherein the flange has an inner surface subdivided in two parts by the web, and an outer surface which extends in parallel relationship to the inner surface.

17. The combination of claim 15 wherein the support means are nuts cast in the side elements.

* * * * *